US006543241B2

(12) United States Patent
Levitin et al.

(10) Patent No.: US 6,543,241 B2
(45) Date of Patent: Apr. 8, 2003

(54) REFRIGERANT FEED DEVICE

(76) Inventors: Mikhail Levitin, P.O. Box 102, Reeders, PA (US) 18352; Boris Khaytin, P.O. Box 102, Reeders, PA (US) 18352

( * ) Notice: Subject to any disclaimer, the term of this patent is extended or adjusted under 35 U.S.C. 154(b) by 0 days.

(21) Appl. No.: 09/728,371

(22) Filed: Dec. 4, 2000

(65) Prior Publication Data

US 2003/0019239 A1 Jan. 30, 2003

(51) Int. Cl.[7] ..... F25B 41/04
(52) U.S. Cl. ..... 62/222; 62/217
(58) Field of Search ..... 62/511, 222, 197, 62/216, 217; 236/928 B; 251/349

(56) References Cited

U.S. PATENT DOCUMENTS 3,659,433 A * 5/1972 Shaw ..... 62/511
4,633,681 A * 1/1987 Webber ..... 62/511
5,056,329 A * 10/1991 Wilkinson ..... 62/197
5,626,030 A * 5/1997 Nagai ..... 62/324.6
6,012,300 A * 1/2000 Tomatsu et al. ..... 62/222
6,134,900 A * 10/2000 Nishida et al. ..... 62/216
6,189,326 B1 * 2/2001 Tomatsu et al. ..... 62/222
6,334,322 B2 * 1/2002 Kubota et al. ..... 62/204
6,334,324 B1 * 1/2002 Muta et al. ..... 62/222

* cited by examiner

*Primary Examiner*—Denise L. Esquivel
*Assistant Examiner*—Marc Norman

(57) ABSTRACT

The present invention increases the efficiency of a refrigerant system by the addition of a special device that provides a constant amount of steam-generated refrigerant pressure in the condenser and is installed as a bypass to the refrigerant feed device.

6 Claims, 2 Drawing Sheets

REFRIGERANT FEED DEVICE

The present invention relates to expansion devices for refrigerant systems and in particular to a feed device, which has a high efficiency.

BACKGROUND OF THE INVENTION

In a refrigeration system, the liquid refrigerant from the condenser has a relatively higher pressure than is needed in an evaporator. The feed device must be placed between the condenser and the evaporator so that the refrigerant in the evaporator will boil off at allow temperature to produce cooling. There are a number of requirements for this device. The device must deliver the liquid refrigerant into the evaporator in an amount equal to that required to provide the desired cooling effect. This amount will also prevent the liquid refrigerant from entering the suction line to a compressor when the compressor is off. In addition, the device must have a small pressure drop as the liquid refrigerant moves through it.

In Webber's U.S. Pat. No. 4,633,681 it is disclosed that in his feed device for the refrigerant system there is a small pressure drop when the liquid refrigerant moves through it. This simple low cost effective device has some disadvantages. It does not prevent the entering of the liquid refrigerant to the suction line when the compressor is off. In addition, the rise in pressure of the steam-generated refrigerant takes place in the condenser when the heating load on the evaporator is increased. This in turn causes overloading of the compressor and excessive power consumption.

There is a need for a feed device, which will have the advantages of the device disclosed in U.S. Pat. No. 4,633,681, but with the prevention of the liquid refrigerant from entering the compressor when it is off and power losses when the heating load on the evaporator is increased.

SUMMARY OF THE INVENTION

The present invention provides for the improvement of the refrigerant feed device. The refrigerant feed device for a refrigeration system is comprised of a housing with an inlet containing within it one end with a valve-like structure situated in the bottom part of the housing, and a second end for connection to the liquid line for receiving the liquid refrigerant from a condenser. The housing also consists of an outlet disposed with one end with a valve-like structure set and at least one groove orifice formed in the top part of the housing as well as second end for connection to the liquid line for input of liquid refrigerant to the evaporator. The effective cross-section of the inlet is smaller than the effective cross-section of the outlet, creating pressure differences that cause a movable piston with one convex (conical, spherical or ellipsoidal) end and a second flat end with a cylindrical projection to pass into the cone. The refrigerant feed device by means of its inlet line for receives liquid refrigerant from the condenser and by means of its outlet liquid line discharges liquid refrigerant to the evaporator. In order to improve the operation of the refrigerant system an additional device providing a constant amount of steam-generated refrigerant pressure in the condenser is installed as a by-pass to the refrigerant feed device. A relief valve, a solenoid, or an automatic valve with a set point adjustment can be used as the aforementioned device.

DESCRIPTION OF THE DRAWINGS

Detailed descriptions of the preferred embodiments of the present invention are hereby presented with reference made to the accompanying drawings.

The features and advantages of the present invention will become apparent as the invention becomes better understood by reference to the following detailed description in conjunction with the accompanying drawings.

DETAILED DESCRIPTION OF THE EMBODIMENT

The following is a detailed description of the best known mode of implementing the invention. This description is not to be taken in a limiting sense but is made simply for the purpose of illustrating the general principles of the invention. The scope of the invention is defined by the appended claims.

Figure 1:
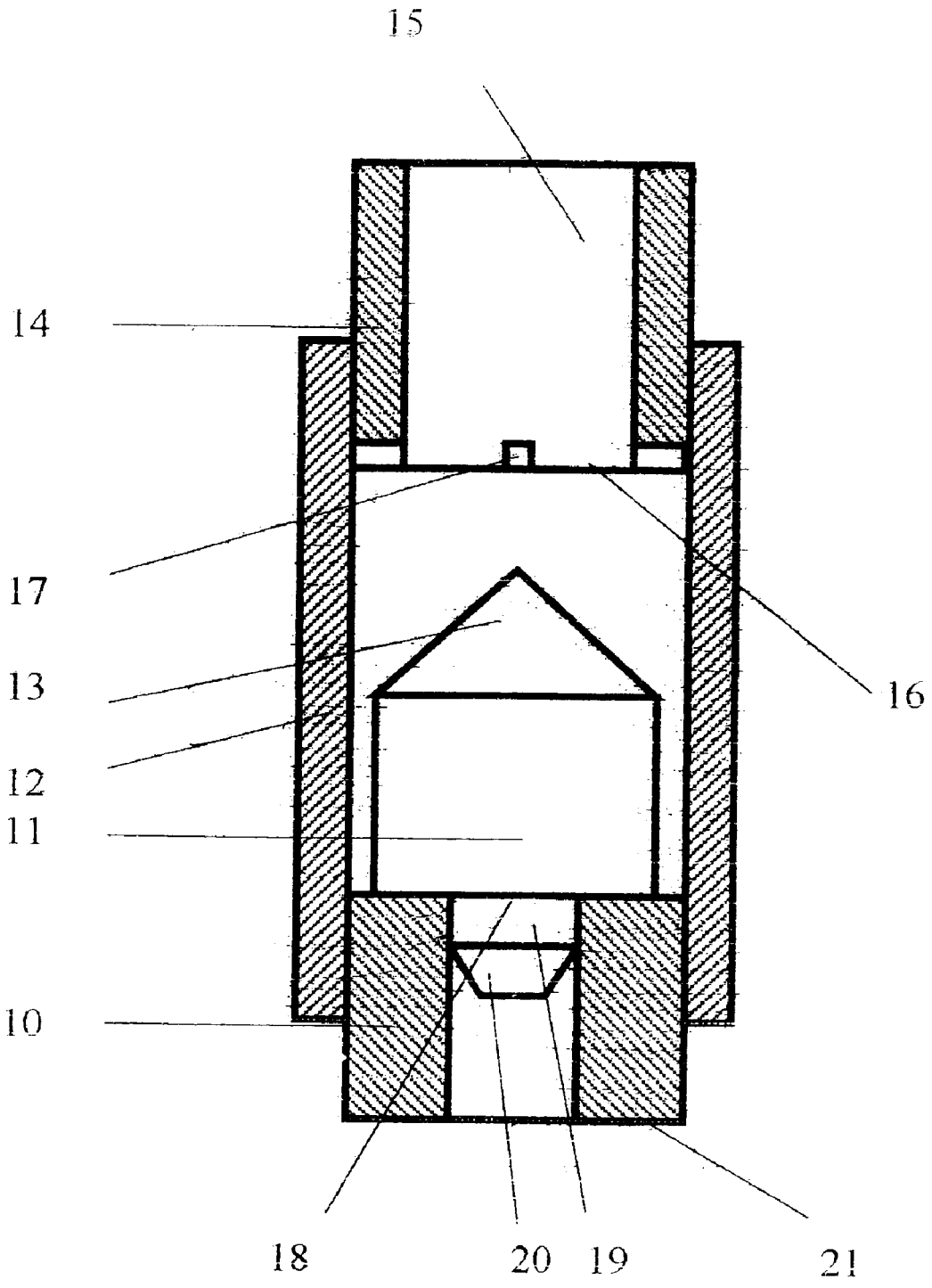
FIG. 1 Shows a cross section of the refrigerant feed device.

Referring to FIG. 1 the refrigerant feed device consists of a housing 12; an inlet 10 disposed with one end 18 with a valve-like set situated in the bottom part of the housing; a second end 21 for connection to the liquid line for receiving the liquid refrigerant from a condenser; an outlet 16 disposed with one end 14 with a valve-like set with at least one groove orifice 17 formed in the top part of the housing; and, a second end 15 for connection to the liquid line for the input of liquid refrigerant to the evaporator. The effective cross-section of the [inlet] outlet 16 is greater than the effective cross-section of the [outlet] inlet 10; a movable piston 11 with one convex (conical, spherical or ellipsoidal) end 13; and a second flat end with a cylindrical projection 19 passing into a cone 20.

The liquid refrigerant from the condenser enters the refrigerant feed device through the inlet 16, lifts the piston 11, and passes through the radial clearance between the inner space of the housing 12 and the piston 11. As a result, the pressure of the refrigerant is decreased and this additional force provides that the top end 13 of the piston 11 closes the end 14 of the outlet 16 so that the refrigerant can pass only through the groove orifice 17. The quantity of the refrigerant passing through the refrigerant feed device is greatly decreased and the housing 12 fills with liquid refrigerant. The pressure drop becomes very, small and the piston 11 passes down under its own gravity. The refrigerant flow through the device is increased and the process is then repeated. If the compressor stops, the pressure in the evaporator is increased and the piston 11 passes down under its own gravity and closes the end 18 of the inlet 10. Because the effective cross-section of the inlet is greater than the effective cross-section of the outlet 10 the refrigerant cannot pass through the device.

Figure 2:
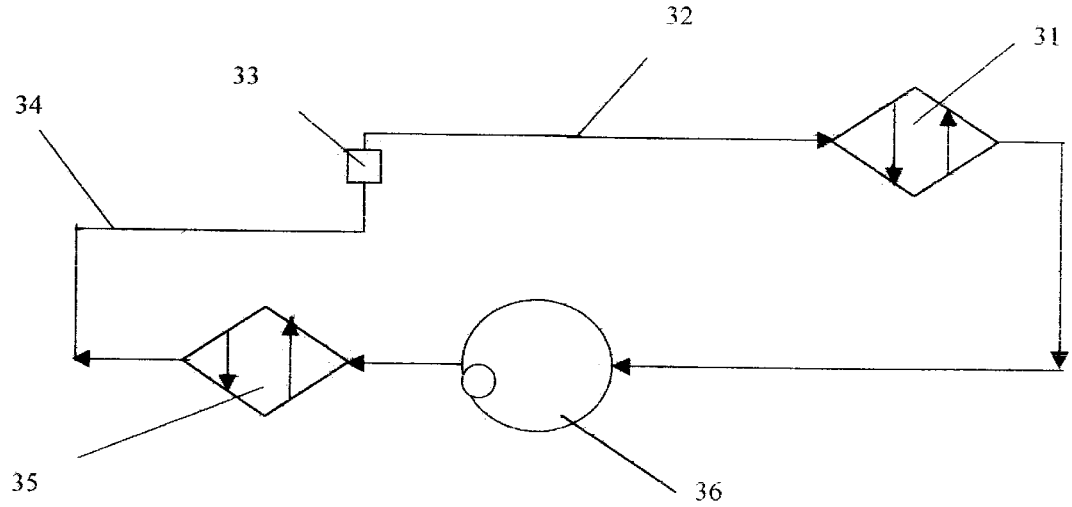
FIG. 2 Is a schematic diagram of the refrigerant system with an installed refrigerant feed device.

FIG. 2 shows a schematic diagram of the refrigerant system with an installed refrigerant feed device comprised of an evaporator 31 connected in a series with a compressor 36, a condenser 35 connected by a liquid line 34 to a refrigerant feed device 33; and, a liquid line 32 connecting the refrigerant feed device 33 to the evaporator 31. The steam-generated refrigerant is sucked in by the compressor 36, compressed to a high pressure and discharged to the condenser 35 where it converted is to liquid. The liquid refrigerant is drawn through the liquid line 34 to the refrigerant feed device 33 which delivers the liquid into the evaporator 31 through the liquid line 32.

Figure 3:
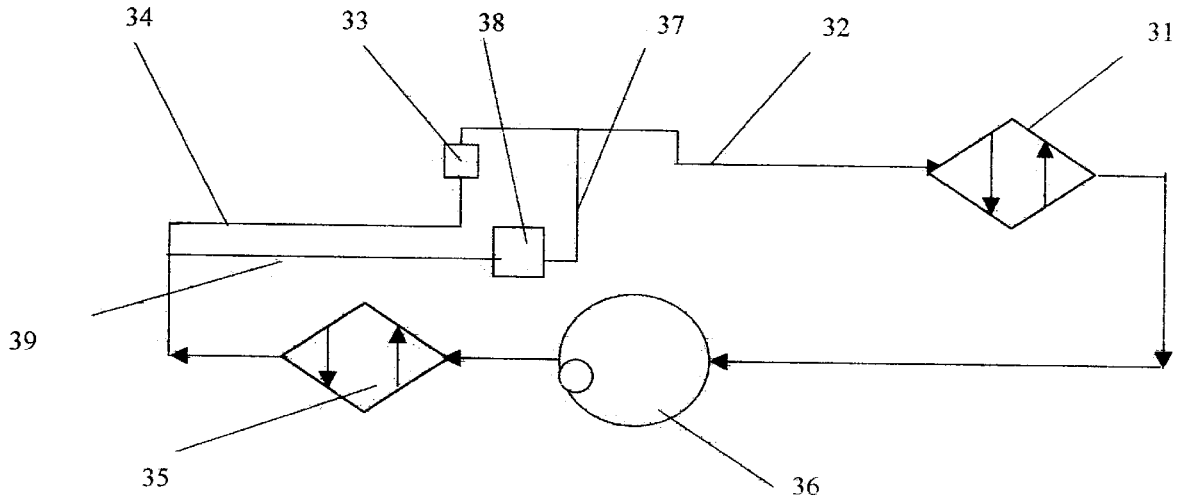
FIG. 3 Is a schematic diagram of the refrigeration system with an installed refrigerant feed device and an additional device which provides a constant amount of the steam generated refrigerant pressure in the condenser.

FIG. 3 shows a schematic diagram of the refrigerant system with an installed refrigerant feed device comprised of an evaporator 31 connected in series with a compressor 36; a condenser 35 connected by a liquid line 34 to a refrigerant feed device 33; a liquid line 32 connecting the refrigerant feed device 33 to the evaporator 31; and, an additional device 38, which provides a constant amount of the steam-generated refrigerant pressure in the condenser. This additional device is installed as a by-pass connected to liquid lines 34 and 32 by lines 39 and 37 respectively. A relief valve, a solenoid, or an automatic valve with a set point can be used as the adjustment device.

The steam-generated refrigerant is sucked in by the compressor 36, compressed to a high pressure and discharged to the condenser 35 where it is converted to a liquid. The liquid refrigerant is drawn to the refrigerant feed device 33, which delivers the liquid refrigerant to the evaporator 31 through liquid line 32. When the pressure of the steam-generated refrigerant in the condenser 35 is increased over the adjusted value, the device 38 opens and the liquid refrigerant is drawn to the evaporator 31 through lines 39 and 37 respectively, thus bypassing the refrigerant pressure device 33. When the pressure in the condenser 35 is reduced the device 38 closes.

Although the present invention has been described in terms of the preferred embodiment above, numerous modifications and/or additions to this embodiment would be readily apparent to one skilled in the art. It is intended that the scope of the present invention extends to modifications and/or additions and that the scope of the present invention is limited solely by the claims set forth below.

We claim:

1. A refrigerant feed device for a refrigeration system, the device, comprised of a housing; an inlet containing within it one end with a valve structure situated in the bottom part of the housing, and a second end for connection to the liquid line for receiving liquid refrigerant from a condenser, an outlet disposed with one end having a valve structure and at least one groove orifice formed in the top part of the housing, and a second end for connection to the liquid line for the input of liquid refrigerant to the evaporator, a movable piston with one convex end; and, a second flat end with a cylindrical projection passing into a cone.

2. The refrigerant feed device for a refrigeration system according to claim 1, wherein the effective cross-section of the inlet is smaller than the effective cross-section of the outlet.

3. The refrigerant feed device for a refrigeration system according to claim 1, wherein the convex end of the movable piston is conical, spherical, or ellipsoidal.

4. A refrigerant system comprising of an evaporator connected in a series with a compressor and a condenser wherein a refrigerant feed device according to the claim 1 is installed between said condenser and evaporator.

5. The refrigerant system according to claim 4, wherein an additional device is installed as a by-pass to the refrigerant feed device.

6. The refrigerant system according to claim 4, wherein the additional device is used in the form of a relief valve, a solenoid, or an automatic valve with a set-point adjustment.

* * * * *